US005493760A

United States Patent [19]

Takimoto

[11] Patent Number: 5,493,760

[45] Date of Patent: Feb. 27, 1996

[54] BIAXIAL HINGE ASSEMBLY

[75] Inventor: Kazuhide Takimoto, Tokyo, Japan

[73] Assignee: Takigen Manufacturing Co. Ltd., Tokyo, Japan

[21] Appl. No.: 265,674

[22] Filed: Jun. 24, 1994

[30] Foreign Application Priority Data

Apr. 11, 1994 [JP] Japan ..... 6-098146

[51] Int. Cl.[6] ..... E05D 3/06

[52] U.S. Cl. ..... 16/366; 16/376

[58] Field of Search ..... 16/366, 376

[56] References Cited

U.S. PATENT DOCUMENTS

| | | | |
|---|---|---|---|
| 255,809 | 4/1882 | Frank | 16/366 |
| 277,925 | 5/1883 | Pfauntz | 16/366 |
| 429,391 | 6/1890 | Slane | 16/366 |
| 1,268,104 | 6/1918 | Lambert | 16/366 |
| 4,928,350 | 5/1990 | Morgan | 16/376 |
| 5,287,596 | 2/1994 | Chen et al. | 16/376 |

*Primary Examiner*—W. Donald Bray
*Attorney, Agent, or Firm*—Martin Smolowitz

[57] ABSTRACT

There is provided a biaxial hinge assembly, which is mounted on a box and a door so as to be flush with a front surface of the box and that of the door. The hinge assembly prevents the door from extending outward in its closed position, and improves the door in its sealing properties to a fixed frame element. In the assembly: each of stopper hinges 5*a*, 5*b* has its one end portion inserted between bearing sleeve portions 9*a* and 9*b* of a stationary wing plate 3, and the other end portion thereof inserted between bearing sleeve portions 10*a* and 10*b* of a rotatable wing plate 4; a first pintle 13 is inserted into bearing sleeve portions 11*a*, 11*b* of the stopper hinges 5*a*, 5*b* and the bearing sleeve portions 9*a*, 9*b*; a second pintle 14 is inserted into the other bearing sleeve portions 12*a*, 12*b* of the stopper hinges 5*a*, 5*b* and the bearing sleeve portions 10*a*, 10*b*; and, stopper projections 7, 8 are formed in base-end portions of the wing plates 3, 4.

3 Claims, 3 Drawing Sheets

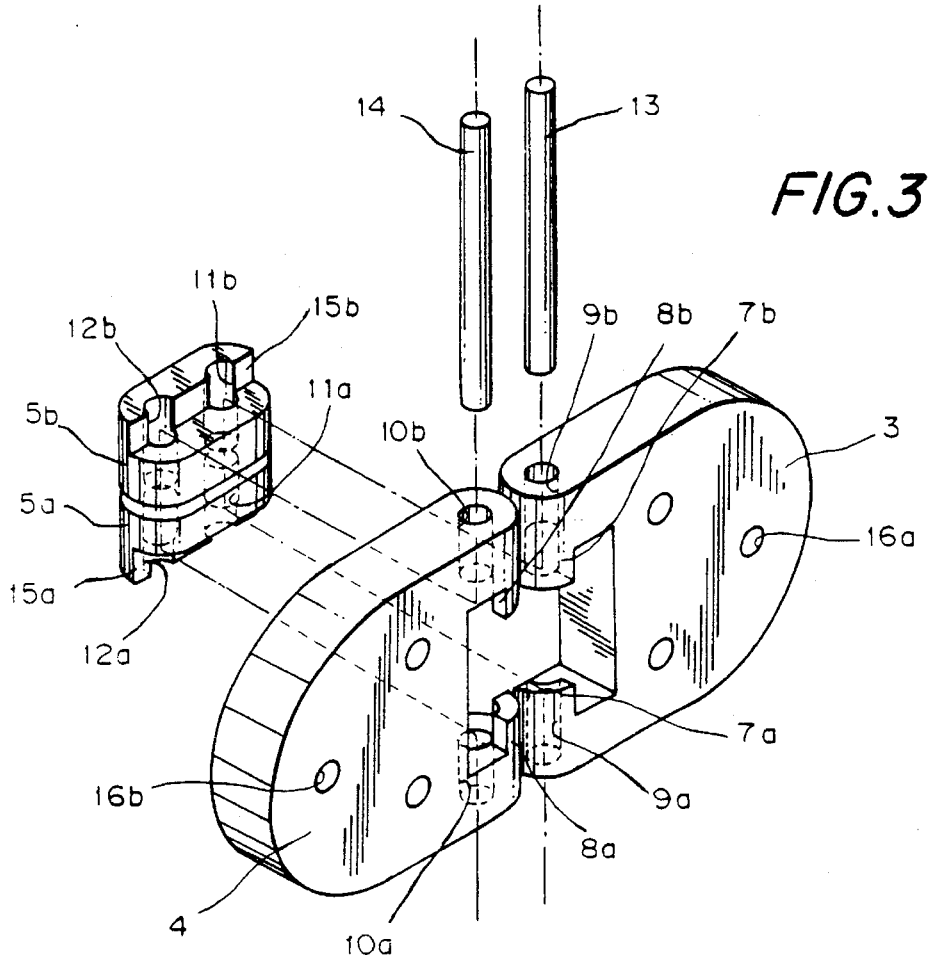
FIG. 3
FIG. 4
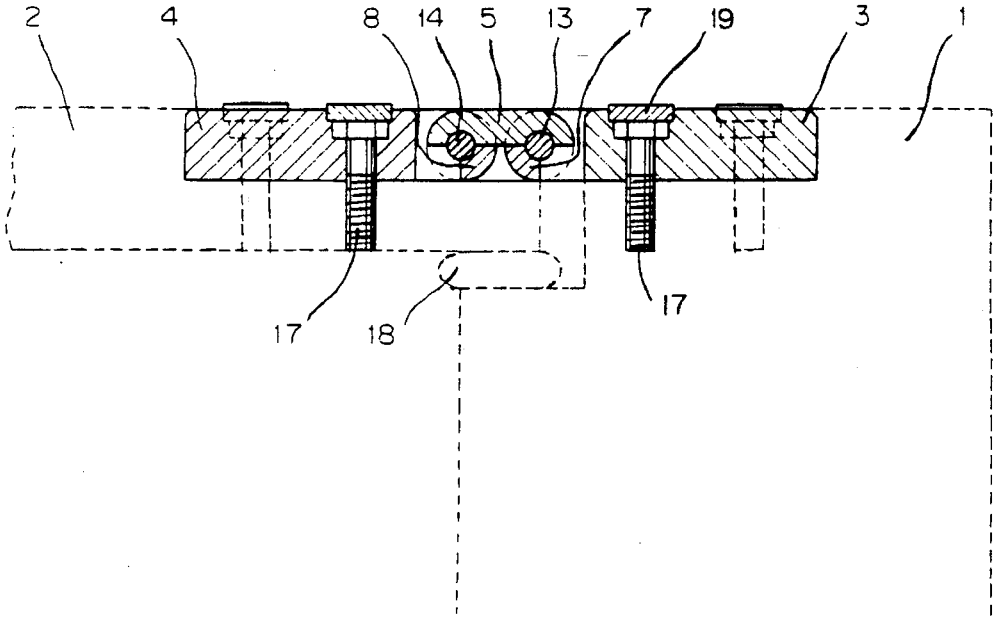

BIAXIAL HINGE ASSEMBLY

BACKGROUND OF THE INVENTION

1. Field of the Invention:

The present invention relates to a biaxial hinge assembly for use on hermetically sealed doors or closures such as hatch covers and the like.

2. Description of the Prior Art:

In a conventional biaxial hinge assembly: a stationary wing plate is rotatably connected with a connecting plate through a first pintle; and, the connecting plate is rotatably connected with a rotatable wing plate through a second pintle. The hinge assembly is mounted between a door and a box body to have the door rotatably mounted on the box body.

However, such conventional hinge assembly is disadvantageous in that the door extends outward in its closed position, because a waterproof packing, which is mounted on a stationary frame element of the box body and the like, is compressed by the door when the door is closed. Such compression produces a compressive stress in the packing which exerts its resilient force on the closed door to have the hinge assembly be partially sung on its first and second pintles as if the assembly were a folding knife in action in the closed position of the door.

Further, after the hinge assembly is mounted between the door and the box body and the like, the connecting plate of the assembly extends outward, which makes it impossible to have a front surface of the door be flush with that of the stationary frame element of the box body and the like in the closed position of the door.

SUMMARY OF THE INVENTION

It is an object of the present invention to provide a biaxial hinge assembly for use on a hermetically sealed door or closure such as a hatch cover and the like, the assembly being provided with a stopper mechanism for preventing the assembly from folding in the closed position of the door, which prevents the door from extending outward in its closed position in which the door has its front surface be flush with that of a box body on which the door is mounted through the hinge assembly; and improves the door in sealing properties.

The above object of the present invention is accomplished by providing:

A biaxial hinge assembly comprising:

a stationary wing plate fixedly mounted on a stationary frame element;

a rotatable wing plate fixedly mounted on a swing door;

a pair of stopper hinges each of which has its one end portion inserted between a pair of bearing sleeve portions of a base-end portion of the stationary wing plate and has the other end portion thereof inserted between a pair of bearing sleeve portions of a base-end portion of the rotatable wing plate;

a pair of E-shaped snap rings mounted between the stopper hinges;

a first pintle inserted in a pair of bearing sleeve portions of end portions of the stopper hinges and in the bearing sleeve portions of the stationary wing plate;

a second pintle inserted in a pair of bearing sleeve portions of the other end portions of the stopper hinges and in the bearing sleeve portions of the rotatable wing plate;

a pair of stopper projections formed in the base-end portion of the stationary wing plate so as to abut on stopper surfaces of the stopper hinges in a closed position of the door; and a pair of stopper projections formed in the base-end portion of the rotatable wing plate so as to abut on the stopper surfaces of the stopper hinges in the closed position of the door.

BRIEF DESCRIPTION OF THE DRAWINGS

FIG. 3 is a perspective exploded view of the biaxial hinge assembly shown in FIG. 2;

FIG. 4 is a cross-sectional view of the biaxial hinge assembly in its closed position, taken along the line 4—4 of FIG. 1;

DESCRIPTION OF THE PREFERRED EMBODIMENTS

Figure 1:
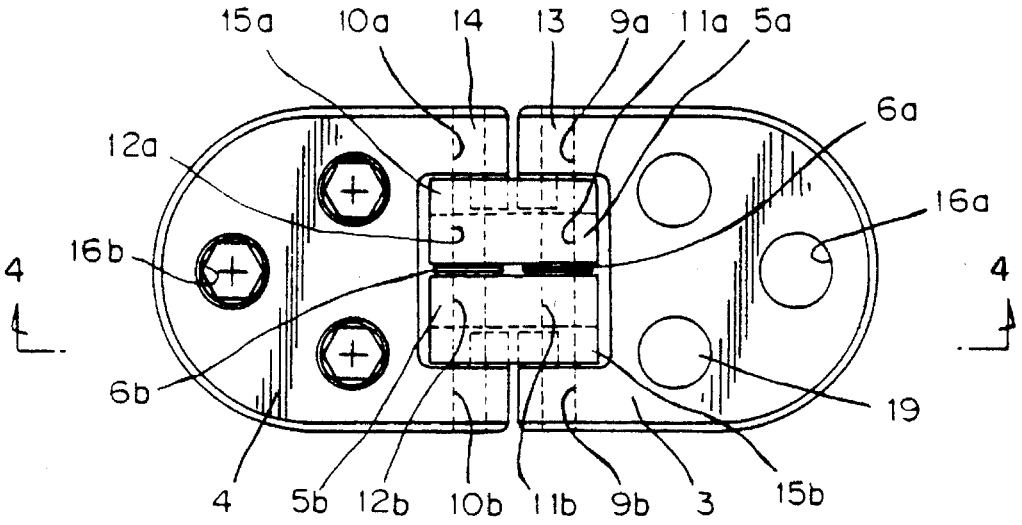
FIG. 1 is a front view of an embodiment of the biaxial hinge assembly of the present invention.
Figure 2:
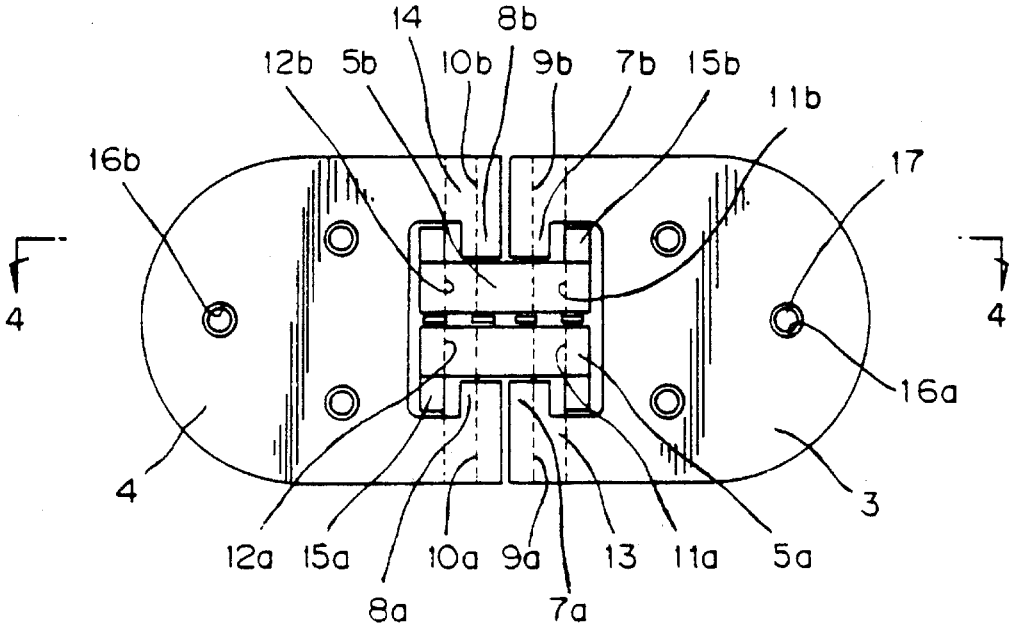
FIG. 2 is a rear view of the biaxial hinge assembly shown in FIG. 1.

Hereinbelow, the present invention will be described in detail with reference to the accompanying drawings and the reference numerals therein.

In a biaxial hinge assembly of the present invention, a stationary wing plate 3 is fixedly mounted on a stationary frame element 1; a rotatable wing plate 4 is fixedly mounted on a swing door 2; each of a pair of stopper hinges 5*a*, 5*b* has its one end portion inserted between a pair of bearing sleeve portions 9*a*, 9*b* of a base-end portion of the stationary wing plate 3, and the other end portion stopper hinges 5*a*, 5*b* inserted between a pair of bearing sleeve portions 10*a*, 10*b* of a base-end portion of the rotatable wing plate 4; a pair of E-shaped snap rings 6*a*, 6*b* are mounted between the pair of stopper hinges 5*a*, 5*b*; a first pintle 13 is inserted in a pair of bearing sleeve portions 11*a*, 11*b* of end portions of the stopper hinges 5*a*, 5*b* and in the bearing sleeve portions 9*a*, 9*b*; a second pintle 14 is inserted in a pair of bearing sleeve portions 12*a*, 12*b* of the other end portions of the stopper hinges 5*a*, 5*b* and in the bearing sleeve portions 10*a*, 10*b*; a pair of stopper projections 7*a*, 7*b* are formed in the base-end portion of the stationary wing plate 3 so as to abut on stopper surfaces 15*a*, 15*b* of the stopper hinges 5*a*, 5*b* in a closed position of the door 2; and a pair of stopper projections 8*a*, 8*b* are formed in the base-end portion of the rotatable wing plate 4 so as to abut on the stopper surfaces 15*a*, 15*b* of the stopper hinges 5*a*, 5*b* in the closed position of the door 2.

In operation, when the swing door 2 is closed (FIG. 4), the stopper projections 7*a* and 7*b* abut on the stopper surfaces 15*a* and 15*b* of the stopper hinges 5*a* and 5*b*, respectively, so that the door 2 is prevented from further swinging in its closing direction. At this time, the stopper projections 8*a* and 8*b* of the rotatable wing plate 4 abut on the above stopper surfaces 15*a* and 15*b* of the stopper hinges 5*a* and 5*b*, respectively, so that the rotatable wing plate 4 is prevented from further rotating, which makes it possible to have the rotatable wing plate 4 be flush with the stopper hinge 5*a*, 5*b* in the closed position of the swing door 2 (FIG. 4).

In an embodiment of the biaxial hinge assembly of the present invention shown in the drawings, the stationary wing plate 3 is provided with three holes 16*a* for receiving set bolts 17. As shown in FIG. 1, these holes 16*a* of the stationary wing plate 3 are so arranged that they form a triangle pattern. The set bolts 17 are hexagon headed bolts through which the stationary wing plate 3 is fixedly mounted on the stationary frame element 1 of a box body and the like. On the other hand, the rotatable wing plate 4 is also provided with three holes 16*b* for set bolts 17. As shown in FIG. 1, these holes 16*b* of the rotatable wing plate 4 are so arranged that they form a triangle pattern as is in the case of the stationary wing plate 3. The set at 19 and 17 are hexagon headed bolts through which the rotatable wing plate 4 is fixedly mounted on the swing door 2 of a refrigerator and the like. The stationary wing plate 3 is rotatably connected with stopper hinges 5*a*, 5*b* through the first pintle 13, while the rotatable wing plate 4 is rotatably connected with the stopper hinges 5*a*, 5*b* through the second pintle 14.

As shown in FIG. 4 when the swing door 2 is closed, the stopper projections 7*a*, 7*b* of the stationary wing plate 3 abut on the stopper surfaces 15*a*, 15*b* of the stopper hinges 5*a*, 5*b* to prevent the door 2 from further swinging in its closing direction. At the same time, the stopper projections 8*a*, 8*b* of the rotatable wing plate 4 abut on the stopper surfaces 15*a*, 15*b* of the stopper hinges 5*a*, 5*b* to prevent the rotatable wing plate 4 from further rotating, so that the rotatable wing plate 4 is kept flush with the stopper hinges 5*a*, 5*b* in the closed position of the swing door 2, whereby the swing door 2 is prevented from extending outward in its closed position even when the door 2 is subjected to a resilient force exerted by a waterproof packing 18 which is mounted on the stationary frame element 1 and compressed in the closed position of the door 2 so as to exert its resilient force on the door 2.

Figure 5:
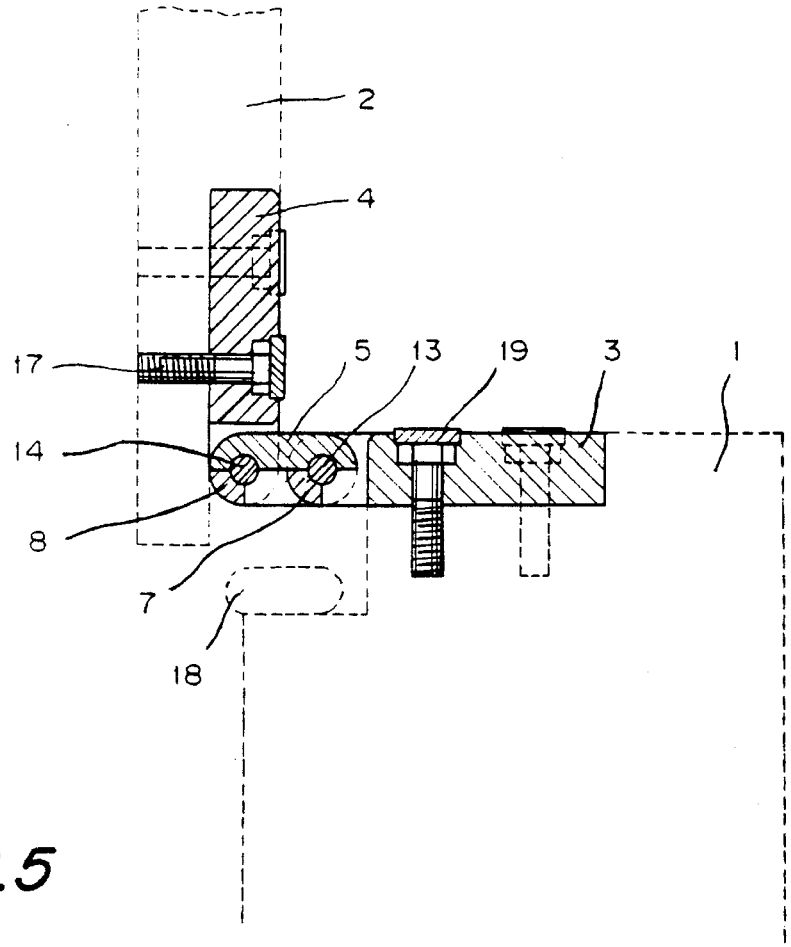
FIG. 5 is a cross-sectional view of the biaxial hinge assembly in its opened position at an angle of 90 degrees, taken along the line 4—4 of FIG. 1.

In opening of the door 2, as shown in FIG. 5, when the door 2 is at a position of an opening angle of 90 degrees, the rotatable wing plate 4 has already rotated on the second pintle 14 through an angle of 90 degrees to have the back surfaces of the stopper projections 8*a*, 8*b* thereof abut on the stopper surfaces 15*a*, 15*b* of the stopper hinges 5*a*, 5*b*, which prevents the rotatable wing plate 4 from further rotating in the opening direction of the door 2.

Figure 6:
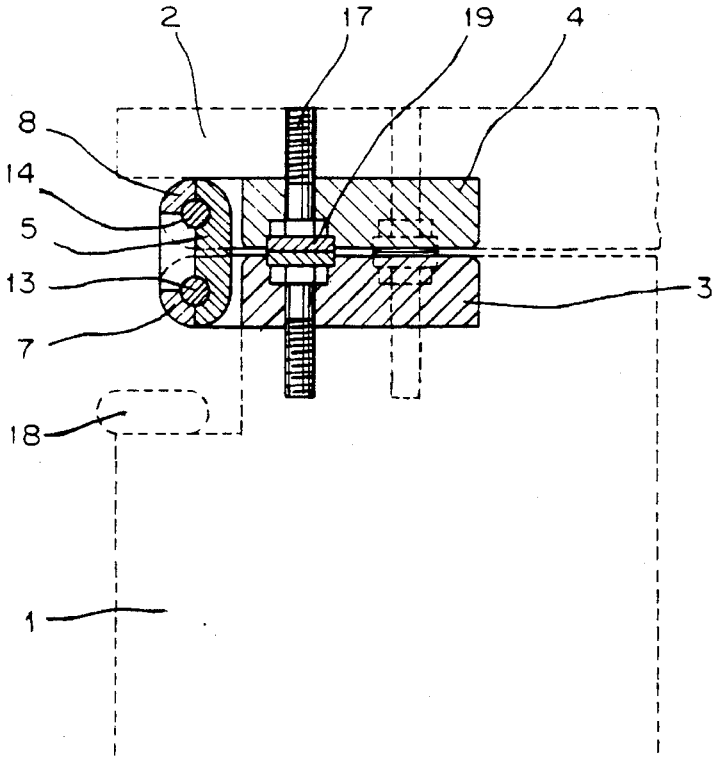
FIG. 6 is a cross-sectional view of the biaxial hinge assembly in its fully opened position at an angle of 180 degrees, taken along the line 4—4 of FIG. 1.

Then, as shown in FIG. 6, when the door 2 is at a position of an opening angle of 180 degrees, the stopper hinges 5*a*, 5*b* have already rotated on the first pintle 13 through an angle of 90 degrees to have their stopper surfaces 15*a*, 15*b* abut on the back surfaces of the stopper projections 8*a*, 8*b* of the stationary wing plate 3, which prevents the stopper hinges 5*a*, 5*b* from further rotating in the opening direction of the door 2 so that the door 2 is held in its position of the opening angle of 180 degrees relative to the stationary frame element 1.

In effect, in the biaxial hinge assembly of the present invention having the above construction, the wing plates 3, 4 and the stopper hinges 5*a*, 5*b* are linearly arranged so as to hold the wing plates 3, 4 flush with the stopper hinges 5*a*, 5*b* in the closed position of the door 2.

Further, in the hinge assembly of the present invention, since the wing plates 3, 4 are provided with the stopper projections 7*a*, 7*b* and 8*a*, 8*b* which abut on the stopper surfaces 15*a*, 15*b* of the stopper hinges 5*a*, 5*b* when the door 2 is closed, it is possible to prevent the hinge assembly from rotating on both the first pintle 13 and the second pintle 14 in the closed position of the door 2 by the provisions of the stopper projections 7*a*, 7*b* and 8*a*, 8*b* together with the stopper surfaces 15*a*, 15*b* of the stopper hinges 5*a*, 5*b*, which also improves the swing door 2 in sealing properties.

What is claimed is:

1. A biaxial hinge assembly, comprising;

a stationary wing plate (3) adapted for fixedly mounting on a stationary frame element (1);

a rotatable wing plate (4) adapted for fixedly mounting on a swing door (2);

a pair of stopper hinges (5*a*, 5*b*) each of which as first and second end portions, the first end portion being inserted between a pair of bearing sleeve portions (9*a*, 9*b*) of a base-end portion of said stationary wing plate (3) and the second portion being inserted between a pair of bearing sleeve portions (10*a*, 10*b*) of a base-end portion of said rotatable wing plate (4);

a pair of E-shaped snap rings (6*a*, 6*b*) mounted between the first and second end portions of said stopper hinges (5*a*, 5*b*);

a first pintle (13) inserted in a pair of bearing sleeve portions (11*a*, 11*b*) of the first end portion of said stopper hinges (5*a*, 5*b*) and in said bearing sleeve portions (9*a*, 9*b*);

a second pintle (14) inserted in a pair of bearing sleeve portions (12*a*, 12*b*) of the second end portion of said stopper hinges (5*a*, 5*b*) and in said bearing sleeve portions (10*a*, 10);

a pair of stopper projections (8*a*, 7*b*) formed in said base-end portion of said stationary wing plate (3) so as to abut on stopper surfaces (15*a*, 15*b*) of said stopper hinges (5*a*, 5*b*) in a closed position of the door (2); and a pair of stopper projections (8*a*, 8*b*) formed in said base-end portion of said rotatable wing plate (4) so as to abut on said stopper surfaces (15*a*, 15*b*) of said stopper hinges (5*a*, 5*b*) in the closed position of the door (2).

2. The biaxial hinge assembly of claim 1, wherein said stationary wing plate (3) is fixedly mounted on said stationary frame with multiple bolts (17) and said rotatable wing plate (4) is fixedly mounted on said swing door (2) with multiple bolts (17).

3. The biaxial hinge assembly of claim 2, wherein said bolts (17) extend through three holes (16*a*) provided in the stationary wing plate (3), and extend through three holes (16*b*) provided in the rotatable wing plate (4).

* * * * *